United States Patent [19]

Strollo

[11] Patent Number: 4,667,346

[45] Date of Patent: May 26, 1987

[54] NECKTIE RETAINER AND METHOD FOR SECURING NECKTIE

[76] Inventor: Joyce J. Strollo, 689 W. Main St., Cheshire, Conn. 06410

[21] Appl. No.: 919,209

[22] Filed: Oct. 15, 1986

[51] Int. Cl.[4] ..... A41D 25/14

[52] U.S. Cl. ..... 2/152 R; 2/152 A; 2/148

[58] Field of Search ..... 2/152 A, 152 R, 148, 2/149, 145, 144

[56] References Cited

U.S. PATENT DOCUMENTS

| | | | |
|---|---|---|---|
| 280,694 | 7/1883 | Warner | 2/152 A |
| 890,113 | 6/1908 | Wilson | 2/152 A |
| 1,443,684 | 1/1923 | Hoppe | 2/152 R |
| 3,538,510 | 11/1970 | Davis | 2/152 R |
| 4,159,542 | 7/1979 | Pehr | 2/152 R |
| 4,173,792 | 11/1979 | Intengan | 2/148 X |

FOREIGN PATENT DOCUMENTS

| | | | |
|---|---|---|---|
| 419724 | 1/1911 | France | 2/152 R |

*Primary Examiner*—Werner H. Schroeder
*Assistant Examiner*—J. L. Olds
*Attorney, Agent, or Firm*—McCormick, Paulding & Huber

[57] ABSTRACT

A conventional four-in-hand necktie worn with a shirt having a wing tip collar and secured in wearing position by a necktie retainer having front and rear parts integrally joined at the upper ends thereof by a connecting part forming an included angle therebetween. The necktie is threaded through apertures in the front and rear parts and depends from the retainer which replaces a conventional knot usually used to secure a necktie of this type. A portion of the retainer is exposed in wearing position between the wing tips of the collar and serves as an accent piece. The retainer eliminates the need for knotting the necktie.

14 Claims, 11 Drawing Figures

NECKTIE RETAINER AND METHOD FOR SECURING NECKTIE

BACKGROUND OF THE INVENTION

This invention relates in general to articles of jewelry and deals more particularly with an improved necktie retainer for use with a conventional four-in-hand necktie worn with a man's shirt which is buttoned at the neck and has a conventional wing tip collar. The invention is further concerned with a method for securing a necktie of the aforedescribed general type.

A man's four-in-hand necktie is usually knotted in place. However, repeated tying and untying produces wrinkles which are difficult, if not impossible, to remove and which detract from the appearance of a necktie and substantially reduce its effective life. Further, some persons experience difficulty in properly tying a necktie to result in front and rear aprons of substantially equal length.

Accordingly, it is the general aim of the present invention to provide an improved necktie retainer which enables a four-in-hand necktie to be worn without a knot. A further aim of the invention is to provide an improved tie retainer to be worn with a necktie as an article of jewelry or accent piece. Yet another aim of the invention is to provide an improved method for securing a necktie of the aforesaid type in wearing position.

SUMMARY OF THE INVENTION

In accordance with the present invention, a necktie having elongated front and rear apron portions integrally joined by a connecting neckband portion is releasably secured in wearing position by a unitary necktie retainer which has a front part, a rear part, and a generally rectilinearly extending connecting part integrally joined to and connecting the upper ends of said front and rear parts. At least a portion of the front part is disposed within one plane and at least a portion of the rear part is disposed within another plane intersecting the one plane along a line of intersection generally parallel to the direction of extent of the connecting portion. The two intersecting planes form an included angle not greater than 45 degrees. The front part has a first aperture through it and spaced from the connecting part. The part has a second aperture which extends through it and is also spaced from the connecting part. In wearing position the front apron is disposed in generally overlying relation to the rear apron and depends from the necktie retainer. The front and rear aprons extending upwardly between the front and rear parts of the retainer and upwardly and outwardly through the first aperture, overlie the upper portion of said front part and extend over said connecting part. The front and rear aprons further extend from the connecting part downwardly over the upper portion of said rear part and downwardly and inwardly through said second aperture. The front apron further extends from said second aperture between said front and rear parts and laterally outwardly toward one end of said retainer immediately below the connecting portion and forms a junction with one end of the neckband portion proximate one end of the retainer. The rear apron portion further extends from said second aperture between said front and rear parts and laterally outwardly toward the other end of the retainer immediately below the connecting portion and forms a junction with the other end of the neckband proximate said other end of said necktie retainer. The neckband forms a closed neck receiving loop extending externally of said necktie retainer.

BRIEF DESRIPTION OF THE DRAWING

DETAILED DESCRIPTION OF PREFERRED EMBODIMENTS

A necktie retainer of the type which the present invention is concerned is particularly adapted for use in combination with a conventional necktie of the four-in-hand type when worn with a conventional man's shirt having a wing tip collar and buttoned at the neck.

Figure 2:
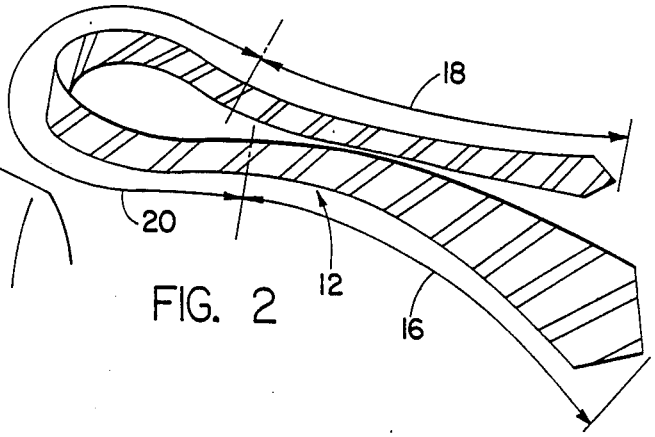
FIG. 2 is a perspective view of a typical four-in-hand necktie used in practicing the invention.
Figure 3:
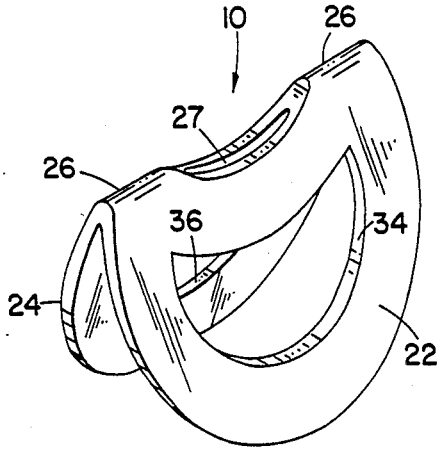
FIG. 3 is a somewhat enlarged perspective view of the necktie retainer of FIG. 1.
Figure 4:
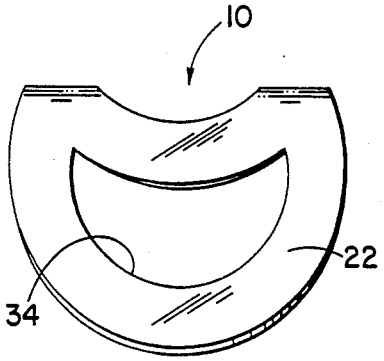
FIG. 4 is a front elevational view of the necktie retainer of FIG. 1.
Figure 5:
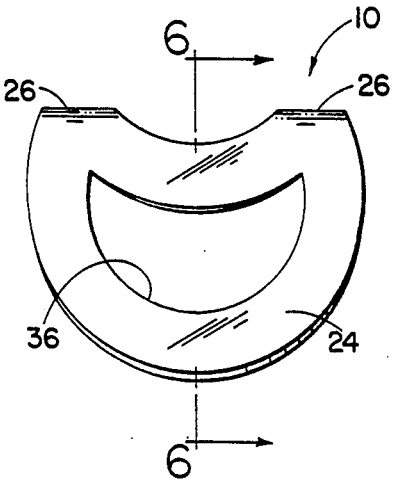
FIG. 5 is a rear elevational view of the necktie retainer.

Turning now the the drawing, a necktie retainer embodying the present invention and indicated generally by the reference numeral 10 is shown in combination with a typical necktie, indicated generally at 12, and in a wearing position relative to a man's shirt of the aforedescribed general type indicated by the numeral 14. The parts of a typical four-in-hand necktie 12 are identified in FIG. 2 of the drawing to assist in a fuller understanding of the further description which follows. Specifically, the necktie 12 is made from flexible fabric and may include a lining. It has an elongated tapered front apron portion 16, which diverges toward its free end, a somewhat narrower rear apron portion 18, having a length approximately equal to the length of the front apron portion, and a neckband portion 20 integrally connected to and extending between the front apron portion 16 and the rear apron portion 18.

In its presently preferred form, the necktie retainer comprises a unitary structure formed from flat metal or like material. The retainer may vary somewhat in shape and form and may, for example, have a somewhat concave-convex surface congifuration, but preferably, and as shown, the necktie retainer 10 comprises a front part 22, a rear part 24 and at least one generally rectilinearly extending connecting part 26 integrally joined to and connecting the upper ends of the front part 22 and the rear part 24. However, the illustrated necktie retainer 10 has two laterally spaced apart connecting parts 26,26 separated by an opening 27 defined by portions of the first and second parts 22 and 24.

Figure 6:
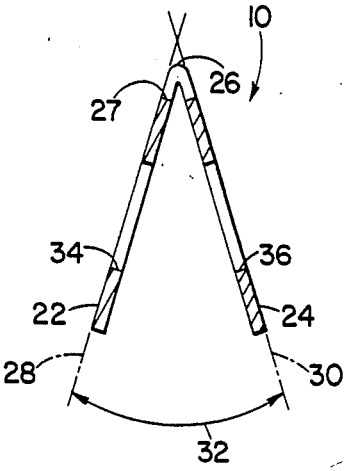
FIG. 6 is a sectional view taken along the line 6-6 of FIG. 5.

The front part is generally disposed within an imaginary first plane 28 and the second part is generally disposed within an imaginary second plane 30 which intersects the first plane along a line of intersection generally parallel to the connecting portion as shown in FIG. 6. The first and second planes 28 and 30 form an included angle 32 not greater than 45 degrees. The first part 22 defines a first aperture 34 which extends through it and is spaced downwardly from the connecting part 26. A second aperture 36 is defined by the rear part 24 and extends through it in downwardly spaced relation to the connecting part 26. The shape of the first and second apertures may vary, but preferably, the upper portion of each aperture is defined by an edge which extends in a direction generally parallel to the direction of extent of said connecting portion. In the illustrated embodiment 10 the first and second apertures are substantially identical, the upper portion of each aperture being defined by a generally arcuate edge of parti-circular form which extends the full width of the aperture. The lower portion of each aperture is also formed by a generally arcuate edge of parti-circular form, substantially as shown.

Figure 1:
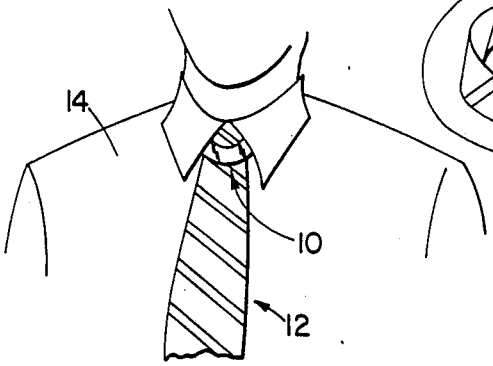
FIG. 1 is an elevational view showing a necktie retainer embodying the present invention in a wearing position.

Preparitory to joining the necktie 12 with the retainer 10, the necktie is positioned with its neckband under the wearer's shirt collar and partially encircling the neck of the wearer. The free ends of the front and rear aprons 16 and 18 are brought together in front of the wearer so that the front apron 16 overlays a substantial portion of the rear apron 18. The retainer 10 is then held in an inverted position in front of the wearer and with the rear part 24 facing in the direction of the wearer's chest. The front and rear aprons 16 and 18 are now inserted between the front and rear parts 22 and 24 and through the second aperture 36. The retainer 10 is now slid upwardly along the front and rear aprons to a position near the collar of the shirt. The retainer 10 is now rotated upwardly and outwardly away from the wearer's chest and relative to the necktie 12 and to a position wherein the connecting parts 26,26 are close to the buttoned neck of the collar. The front and rear aprons 16 and 18 now extend upwardly from the second aperture 36 and over the connecting parts 26,26. The free end portions of the front and rear aprons are next tucked through the first aperture 34 and drawn downwardly between the lower end portions of the front and rear parts 22 and 24 to a depending position wherein the front and rear aprons 16 and 18 depend from the retainer 10. The necktie 12 and its retainer 10 are now in a wearing position. The wing tips of the collar may now be adjusted, as necessary, to cover the opposite ends of the retainer so that only a decorative portion of the retainer 10 is exposed at the shirt collar, as shown in FIG. 1.

Figure 7:
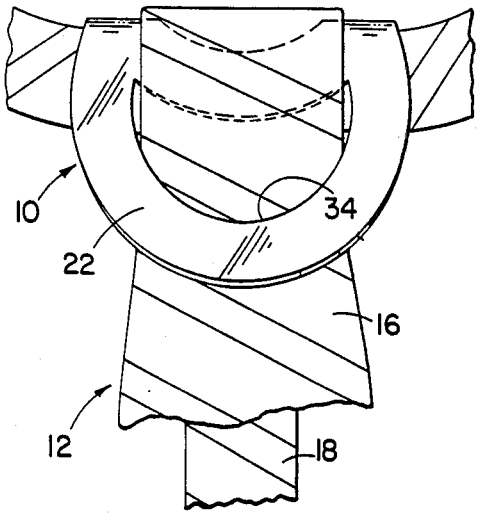
FIG. 7 is a somewhat further enlarged fragmentary front elevational view of a necktie assembled in wearing position with the necktie retainer.
Figure 8:
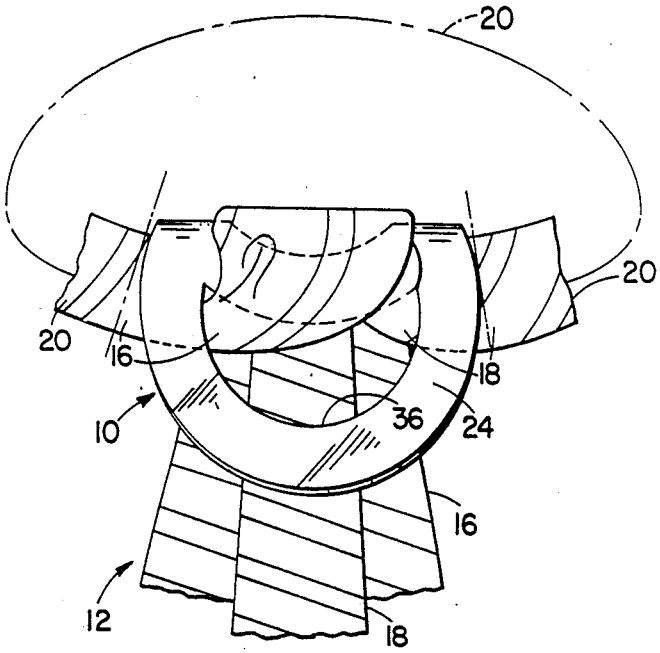
FIG. 8 is a fragmentary rear elevational view of the necktie and retainer shown in FIG. 7.

Referring now to FIGS. 7 and 8, the necktie retainer 10 and the necktie 12 are shown assembled in wearing position. Referring first to the frontal view, FIG. 7, it will be apparent that the front apron 16 is disposed in generally overlying relation to the rear apron 18, and that both aprons depend from the retainer 10. The front and rear apron 16 and 18 extend upwardly between the front and rear parts 22 and 24 and outwardly through the first aperture 34. Further, the front and rear aprons extend upwardly from the first aperture into overlying relation with the upper portion of the front part 22 and further extend over the connecting parts 26,26 and downwardly over the upper portion of the rear part 24 as best shown in FIG. 8, a rear view of the retainer and necktie assembly. Further referring to FIG. 8, the front and rear aprons 16 and 18 extend downwardly through the second aperture 36 and further extend from the second aperture 36 between the front and rear parts 22 and 24 and in laterally outwardly in opposite directions. More specifically, the rear apron 18 extends laterally outwardly toward the right hand end of the retainer 10, as it appears in FIG. 8, below the connecting portion 26 and forms a junction with one end of the neckband portion 20 proximate the right hand end of the retainer 10. The front apron portion 16 also extends downwardly through the second aperture 36 but in a laterally opposite direction from the rear apron 18 and toward the opposite or left hand side of the retainer below the connecting portions 26,26 and forms a junction with the other end of the neckband portion 20 proximate the left hand end of the retainer, as it appears in FIG. 8. The neckband 20 forms a closed neck receiving loop externally of the necktie retainer 10 the later loop being shown in broken lines in FIG. 8 and indicated by the numeral 20.

In accordance with another method for securing a necktie in wearing postion, the retainer 10 may be assembled with the necktie 12 before the necktie is placed around the wearer's neck. The necktie 12 is first folded in half and onto itself at the neckband 20 to bring one half the neckband into overlying relation with the other half and the front apron 16 into overlying relation with the rear apron 18. The folded portion of the neckband 20 is then passed upwardly between the first and second parts 22 and 24 and through the first aperture 34 to cause the free end portions of the front and rear aprons to depend from the necktie retainer between the front and rear parts and to expose the neckband and portions of the front and rear aprons in front of the upper portion of the necktie retainer. The folded portion of the neckband is then passed over the retaining portions 26,26 and downwardly through the second aperture 36 to bring an exposed portion of the rear apron and the associated overlying portion of the front apron into overlying relation with the connecting portion 26,26. One end portion of the neckband is then drawn laterally outwardly from between one side of the front and rear parts 22 and 24 generally adjacent the under side of an associated connecting part 26. The other end portion of the neckband is then drawn laterally outwardly from between the front and rear parts generally adjacent the underside of the other connecting part 26, whereby the neckband is formed into a neck receiving loop external of the retainer and terminating at opposite sides of the necktie retainer. After, the neck receiving loop is positioned around the neck of the wearer and the shirt collar is adjusted, as necessary, the front and rear aprons are adjusted relative to the necktie retainer 10 to secure the necktie 12 in wearing position.

Figure 9:
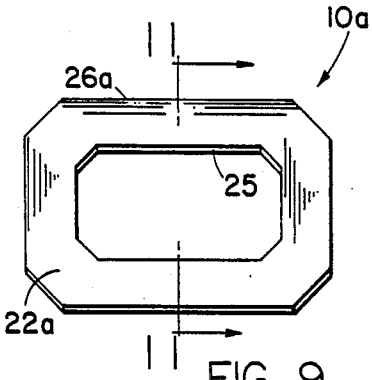
FIG. 9 is a front elevational view of another necktie retainer embodying the present invention.
Figure 10:
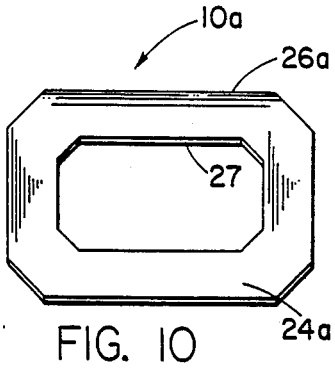
FIG. 10 is a rear elevational view of the necktie retainer of FIG. 9.
Figure 11:
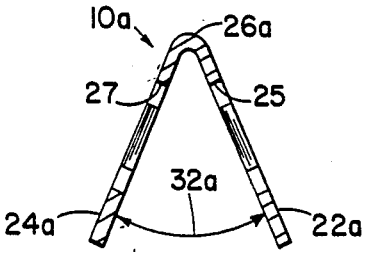
FIG. 11 is a sectional view taken along the line 11-11 of FIG. 9.

Referring now to FIGS. 9–11, another necktie retainer embodying the present invention is indicated generally by the reference numeral 10*a*. The retainer 10*a* is preferably formed from flat metal and includes a front part 22*a*, a rear part 24*a* and a connecting part 26*a* formed by a bent portion of the retainer and having an inverted generally V-shaped cross-section. Substantially identical front and rear apertures 34*a* and 36*a* are formed in the front and rear parts. The upper portion of each aperture is defined by rectilinearly extending edge substantially parallel to the direction of extent of said connecting portion 26*a*, the upper edge of the first aperture being designated by the numeral 25, the upper edge of the second aperture being designated by the numeral 27. Preferably, and as shown, the front and rear parts form an included angle 32*a* therebetween of at least 30 degrees but not exceeding 45 degrees.

I claim:

1. The combination comprising an elongated fabric necktie and a necktie retainer for releasably securing said necktie in wearing position, said necktie having an elongated front apron portion, an elongated rear apron portion and a neckband portion integrally connected to and extending between front apron portion and said rear apron portion, said necktie retainer being a unitary member and having a front part, a rear part, and means for connecting said front part to said rear part including at least one generally rectilinearly extending connecting part integrally joined to and connecting the upper ends of said front part and said rear part, said front part being generally disposed within one plane and said rear part being generally disposed within another plane intersecting said one plane along a line of intersection generally parallel to the direction of extent of said connecting part, said one plane and said other plane forming an included angle not greater than 45 degrees, said front part having a first aperture therethrough spaced from said connecting part, said rear part having a second aperture therethrough spaced from said connecting part, said necktie in said wearing position having said front apron disposed in generally over-lying relation to said rear apron and depending from said necktie retainer, said front and rear aprons extending upwardly between said front and rear parts and outwardly through said first aperture, said front and rear aprons extending upwardly from said first aperture in overlying relation to the upper portion of said front part and further extending over said one connecting part and downwardly over the upper portion of said rear part and inwardly through said second aperture, said front apron further extending from said second aperture between said front and rear parts and laterally outwardly toward one end of said retainer below said one connecting portion and forming a junction with one end of said neckband proximate said one end of said retainer, said rear apron portion further extending from said second aperture between front and rear parts and laterally outwardly toward the other end of said retainer below said connecting portion and forming a junction with the other end of said neckband proximate said other end of said necktie retainer, said neckband forming a closed neck receiving loop externally of said necktie retainer.

2. The combination as set forth in claim 1 wherein said connecting means includes two spaced apart connecting parts having an opening therebetween defined by portions of said front and rear parts.

3. The combination as set forth in claim 1 wherein the upper portion of at least one of said apertures including said first aperture and said second aperture is defined at least in part by a rectilinear edge extending in a direction generally parallel to the direction of extent of said connecting portion.

4. The combination set forth in claim 2 wherein the upper portion of both said first aperture and second aperture is defined at least in part by a rectilinear edge extending in a direction generally parallel to the direction of extent of said connecting portion.

5. The combination as set forth in claim 1 wherein said necktie retainer is formed from flat metal of substantially uniform thickness and said connecting portion comprises a reversely bent portion having a generally V-shaped cross section.

6. The combination as set forth in claim 1 wherein said front part is disposed generally within said first plane and said rear part is disposed generally within said second plane and said first and second planes intersect proximate said connecting portion.

7. The combination as set forth in claim 1 wherein said included angle is not greater than 30 degrees.

8. A necktie retainer formed from flat metal of substantially uniform thickness and comprising a front part, a rear part, and a connecting part integrally connected to and joining said front part to said rear part, said front part and said rear part forming an included angle therebetween not greater than 45 degrees, said front part having a first necktie receiving aperture therethrough spaced from said connecting part, said rear part having a second necktie receiving aperture therethrough spaced downwardly from said connecting part.

9. The combination as set forth in claim 8, wherein at least an upper portion of the boundry defining said first aperture extends in a direction generally parallel to the direction of extent of said connecting portion.

10. A necktie retainer comprising a unitary structure including a front part, a rear part, and a reversely bent connecting portion of some linear extent integrally connected to and extending between said front part and said rear part, said front part having a first necktie receiving aperture therethrough and having an upper boundry spaced downwardly from said connecting part, at least a portion of said upper boundry being disposed in generally parallel relation to said connecting part, said rear part having another necktie receiving aperture therethrough.

11. A necktie retainer as set forth in claim 10 wherein said second aperture is partially defined by an upper boundry at least a portion of which is disposed in generally parallel relation to said connecting part.

12. A method for securing an elongated necktie in wearing position wherein said necktie includes an elongated front apron, an elongated rear apron, and a neckband integrally connected to and extending between said front apron and said rear apron, said method comprising the steps of providing a necktie retainer having a front part, a rear part, and a connecting part securing said front part to said rear part, said front part and said rear part forming an included angle therebetween, said front part having a first aperture therethrough, said rear part having a second aperture therethrough, folding said necktie onto itself at said neckband to bring one half of said neckband into overlying relation with the other half of said neckband and said front apron into overlying relation with said rear apron, passing a portion of said folded necktie through said first aperture to cause portions of said front and rear aprons to depend from said necktie retainer and from between said front part and said rear part and to expose said neckband and portions of said front and rear aprons in front of said necktie retainer, passing said folded portion of said neckband downwardly through said second aperture to bring an exposed portion of said rear apron and the associated overlying portion of said front apron into overlying relation with said connecting portion, drawing one end portion of said neckband laterally outwardly from between one side of said front and rear parts generally adjacent said connecting portion, drawing the other end portion of said neckband laterally outwardly from between the other side of said front part and said rear part generally adjacent said connecting portion whereby to form said neckband into a neck receiving loop terminating at opposite sides of said necktie retainer, positioning said neck receiving loop around the neck, and adjusting the positions of the front and rear aprons relative to the necktie retainer to secure the necktie in wearing position.

13. The method as set forth in claim 12 wherein the step of passing a portion of said necktie through said first aperture is further characterized as inserting the folded portion of said neckband upwardly between said front and rear parts and outwardly through said first aperture.

14. A method for securing in wearing position relative to a shirt collar, a necktie having elongated front and rear aprons and an elongated neckband integrally connected to the aprons and extending therebetween, said method comprising the steps of providing a necktie retainer having a front part, a rear part, and a connecting part integrally joined to and connecting said front part to said rear part, said front part and said rear part forming an included angle therebetween, said front part having a first aperture therethrough spaced from said connecting portion, said rear part having a second aperture therethrough spaced from said connecting portion, positioning said necktie with said neckband partially encircling the neck and said front and rear aprons depending in front of the wearer, holding said necktie retainer with said connecting part facing downwardly, and said rear part facing in a forward direction, bringing the free end portions of the front and rear aprons together, inserting said free end portions downwardly between said front and rear parts and outwardly through said second aperture, sliding said necktie retainer upwardly along said front and rear aprons and to a position near the shirt collar, rotating said connecting portion in an forwardly and upwardly direction bring said front part to a forwardly facing position whereby to cause the front and rear aprons to extend over the connecting portion and to depend from the retainer in front of the front part, inserting the free end portions of the front and rear aprons through said first aperture and downwardly between said first and second parts, drawing said front and rear aprons downwardly through said first aperture to a position wherein said front and rear aprons depend from said retainer between front and rear parts, and adjusting the position of said retainer at said collar.

* * * * *